United States Patent [19]

Tromp

[11] 4,203,530

[45] May 20, 1980

[54] DEVICE TO APPLY A PAPER SHEET TO A CLOSET SEAT

[76] Inventor: Gerardus M. Tromp, The Hague, Netherlands

[21] Appl. No.: 886,600

[22] Filed: Mar. 14, 1978

[30] Foreign Application Priority Data

Dec. 23, 1977 [NL] Netherlands ..... 7714364

[51] Int. Cl.[2] ..... A47K 13/14

[52] U.S. Cl. ..... 221/186; 221/259; 4/246

[58] Field of Search ..... 221/186, 188, 210, 245, 221/259, 277; 4/242, 243, 244, 246

[56] References Cited

U.S. PATENT DOCUMENTS 3,693,198 9/1972 Tromp ..... 4/246

FOREIGN PATENT DOCUMENTS 62702 12/1890 Fed. Rep. of Germany ..... 4/246
2438932 4/1976 Fed. Rep. of Germany ..... 4/244
1029610 6/1953 France ..... 4/244

*Primary Examiner*—Joseph J. Rolla
*Attorney, Agent, or Firm*—Finnegan, Henderson, Farabow, Garrett & Dunner

[57] ABSTRACT

A device for applying a paper sheet to a water closet seat which includes a paper sheet container adapted to move from a substantially vertical position to a substantially horizontal position over the closet seat by manually operating a tilting mechanism. A rotatable roller is positioned in the container and is driven to feed a paper sheet into position on the closet seat as the container is moved. The paper sheet has a central part which hangs into the closet bowl and causes the sheet to be carried off when the closet is flushed.

10 Claims, 7 Drawing Figures

DEVICE TO APPLY A PAPER SHEET TO A CLOSET SEAT

BACKGROUND OF THE INVENTION

U.S. Pat. No. 3,693,198 discloses a water closet seat provided with a clamping strip rotatable between a clamping position and a rest position. In the vertical position of the seat the strip can clamp a paper sheet from a stock of such paper sheets and carry this sheet along when the seat is moved to the horizontal position. Both the rotatable strip and the closet seat are operated by the same control lever.

It is considered a disadvantage that an essential part of the device, namely, the rotatable clamping strip is journalled in the closet seat itself. Besides, this device is complicated and costly.

SUMMARY OF THE INVENTION

The present invention is intended to provide a device as described above, which can operate wholly independently of a water closet seat, and which can be used with water closet seats of standard construction. Moreover, this invention is intended to provide a device which is reliable and sturdy, and yet is simple and inexpensive.

To meet all these objectives, a device operable to apply a paper sheet to a water closet seat according to this invention comprises a box-shaped container holding a supply of paper sheets fitting the closet seat, and a tilting mechanism to which the container is pivotally secured so that when the tilting mechanism is operated, the container tilts and hinges from a vertical position to a substantially horizontal position. A paper driving roller is journalled inside the container, and a driving mechanism rotates the roller in one direction when the container moves to the substantially horizontal position. A pressing mechanism is provided to press part of the paper stock against the paper driving roller.

When the container is tilted, the rotating roller conveys a single paper sheet from the supply through an opening in the container. As the conveyed sheet gradually emerges from the container, it lands upon the previously lowered closet seat. The paper sheet is provided with a central portion which hangs downwardly into the closet bowl, so that when the closet is flushed, the paper sheet is carried off.

In a preferred embodiment, the tilting mechanism is formed by two pairs of tilting rods mounted on either side of the paper container, each of said rods having a separate pivot or hinge joint with a fixed frame plate and with the container. The hinged joints between the container and the tilting rods of each pair follow intersecting paths, as a result of which the tilting motion of the container from the vertical position to the substantially horizontal position is brought about.

During tilting motion of the container, the paper driving roller is caused to rotate. An appropriate driving mechanism for the roller may be a belt or chain running over a wheel connected to the paper driving roller via a free wheel coupling.

When a chain is used, it extends from a fastening point on the tilting mechanism or the frame plate to a fixed fastening point on the container via a chain wheel and via a pulley biased upwardly by a spring.

When a belt is used, it extends around a wheel biased in one direction by a helical spring, and one extremity of the belt is fastened to a point on the tilting mechanism or the frame plate.

The pressing mechanism is necessary for correct contact of the paper stock with the paper driving roller. It preferably consists of a pivotal strip positioned in front of the paper driving roller, the strip being drawn or pushed toward the roller by means of a spring. One paper sheet only is carried along by the roller.

During the last part of conveyance of a paper sheet, a following sheet should be prevented from being carried along. Consequently, the pivotal strip is provided with a cam which, at the final stretch of the tilting motion of the container, engagages a cam mounted on one of the tilting rods for the purpose of disengaging the strip from the paper driving roller.

Likewise, a partly tilted container with part of a paper sheet protruding from it should be prevented from moving backwards to its starting position. For that purpose, the tilting mechanism of the container is provided with means to prevent a backward motion in the opposite tilting direction through a considerable part of the tilting movement of the container.

This means may consist of a cam pivotally secured to one tilting rod, the cam being biased in one direction by a spring and cooperating with a fixed cam surface.

In order to prevent a paper sheet from adhering to the paper driving roller, a cam may be mounted on the rear wall, the teeth of which can fit into grooves in the roller.

The invention will now be further illustrated with the aid of the figures in which two exemplary embodiments are represented.

DETAILED DESCRIPTION

Figure 1:
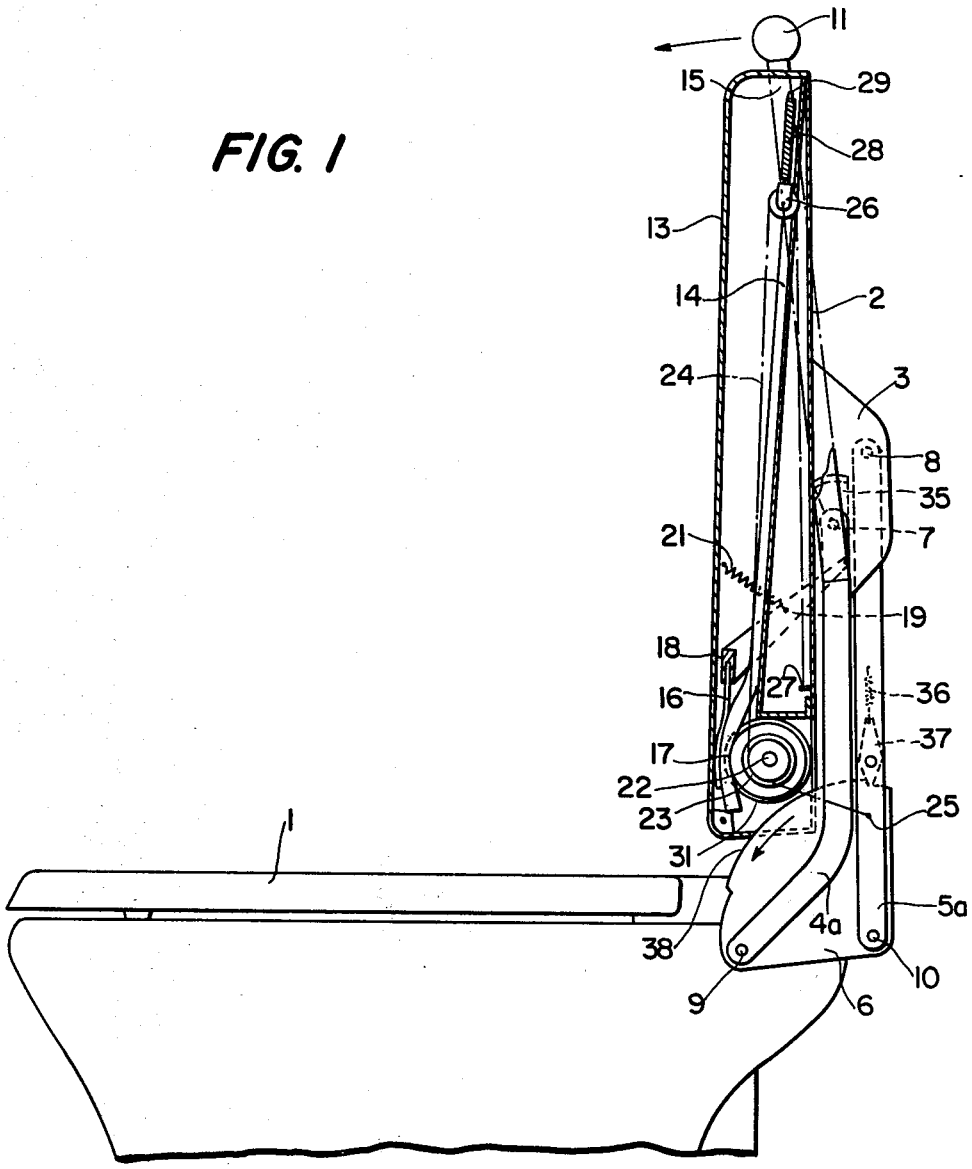
FIG. 1 is a side view of a first embodiment of a device according to the invention and shown in the non-operated position, in which a side wall of the container of the device is broken away.

The apparatus illustrated is intended to place a horseshoe-shaped paper sheet with an intermediate flushing section upon a water closet seat which is moved downwardly to a horizontal position.

In the embodiment of FIGS. 1–5, the present invention is applied to the rear of a water closet seat of conventional shape and construction, that seat being indicated at 1.

In this embodiment, an essentially box-shaped paper container 2 has a rearwardly projecting ear 3 on either side. A first pair of tilting rods **4*a* and 5*a* are pivotally secured at one end by pivot pins 7 and 8 to one ear 3, and at the other end by pivot pins 9 and 10 to a fixed frame 6. A second pair of tilting rods 4*b* and 5*b* are similarly pivotally connected to the other ear 3 by pivot pins 7 and 8, and to frame 6 by pins 9 and 10**. These rods, in turn, are pivotally secured to a frame 6. For rigidity, the tilting rods 5a and 5b are interconnected by an intermediate rod.

A control lever 11 is secured to the tilting rod 4a. By moving the control lever 11 forwardly or counterclockwise as viewed in FIGS. 1-3, the rods 4a, 5a, 4b, 5b pivot at the pins 9, 10. The hinged connecting points 7, 8 between the tilting rods and the ear 3 on container 2 follow the intersecting circular paths marked with dot-dash lines in FIG. 2.

Figure 2:
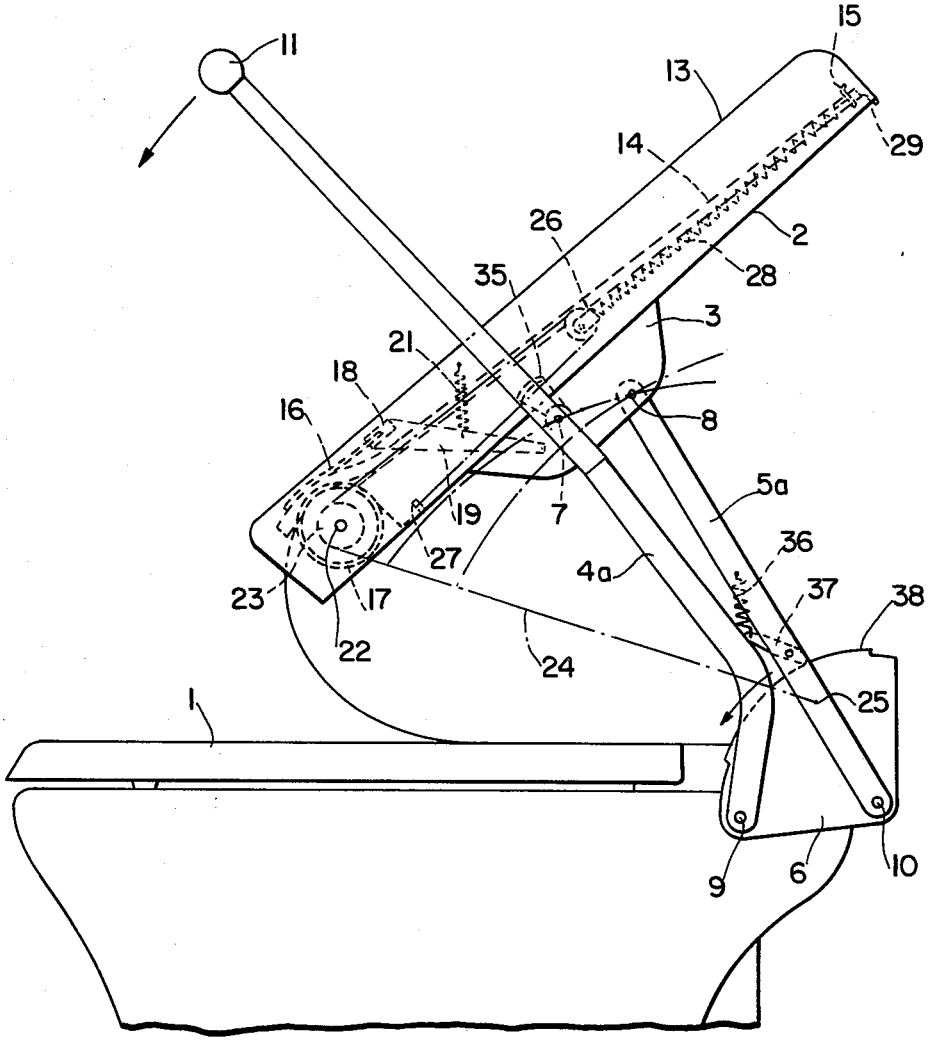
FIG. 2 is a side view similar to FIG. 1 showing the parts in a position in which the container is partly tilted.
Figure 3:
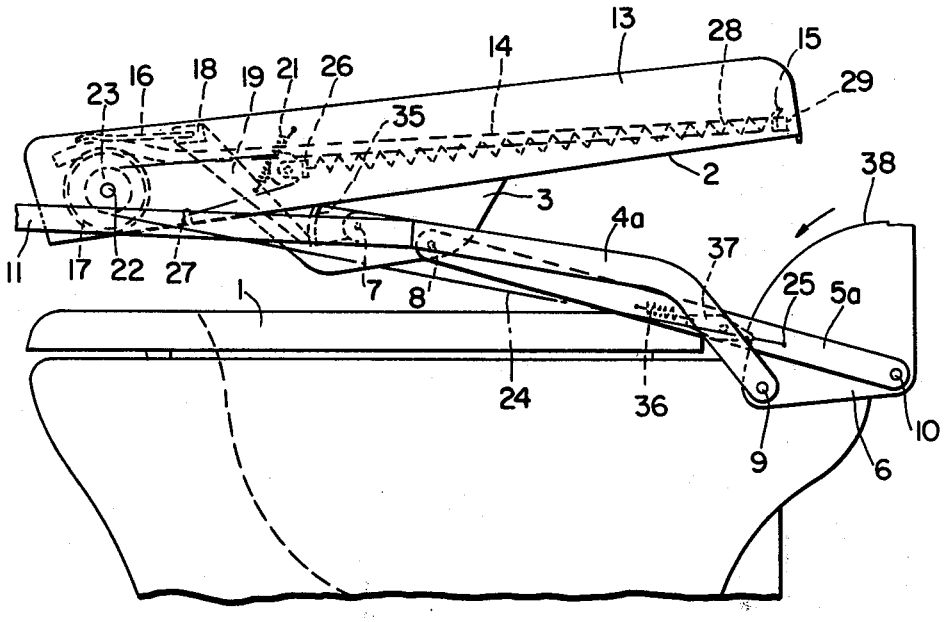
FIG. 3 is an identical side view in the position in which the container is fully tilted.
Figure 4:
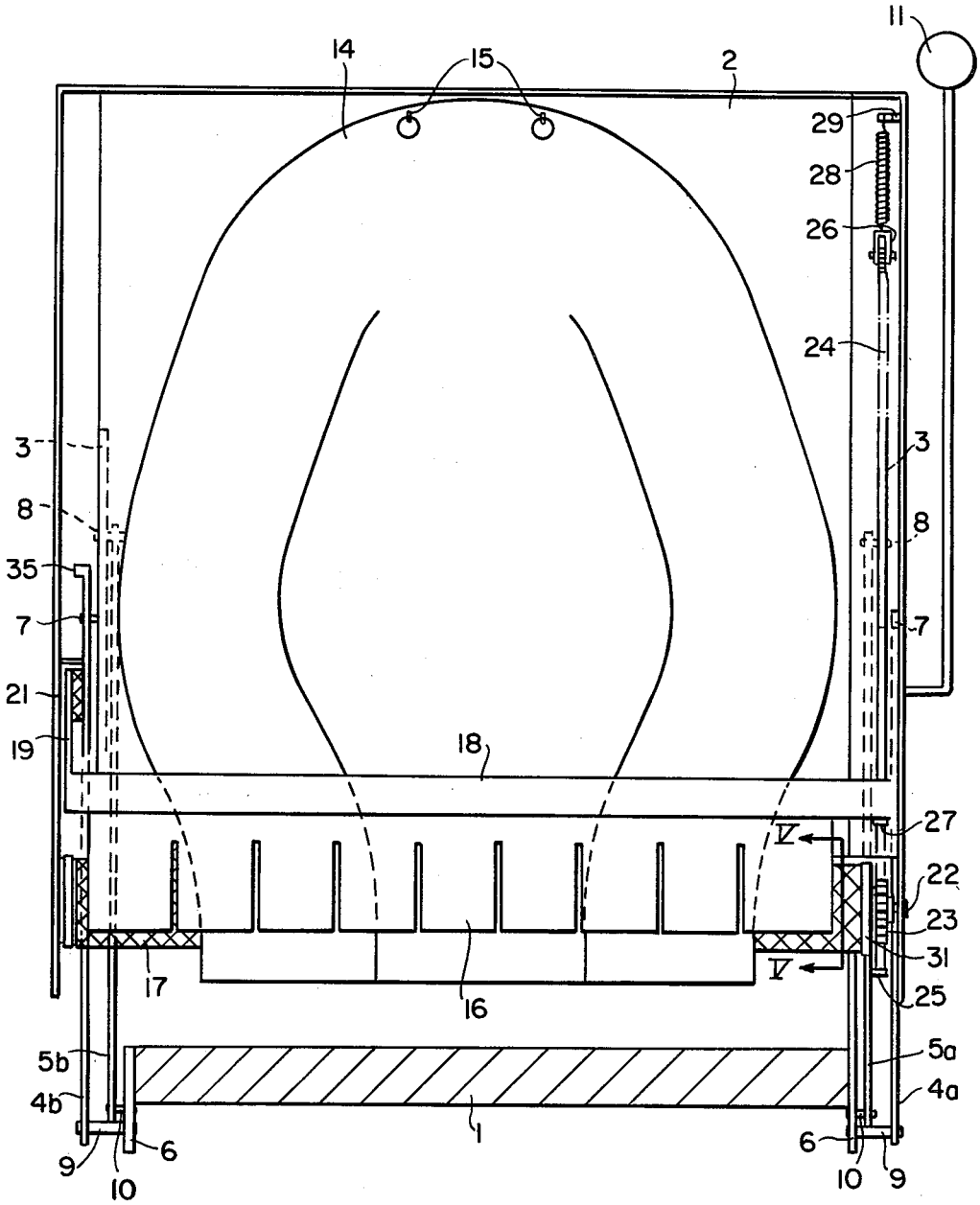
FIG. 4 is a front view of the device with its cover removed.

As the control lever 11 and rods 4a, 5a and 4b, 5b pivot, the container 2 tilts from the vertical position as shown in FIG. 1 to the substantially horizontal position according to FIG. 3 via the intermediate position shown in FIG. 2.

The front of the container 2 is closed by a hinged cover 13. Inside the container, a stack 14 of paper sheets fitting the closet seat is hung at 15. Each of these paper strips is provided with a center strip which can hang down in the closet bowl and by means of which the strip is carried off when the closet is flushed.

The lower part of said paper stack 14 is pressed against a paper driving roller 17 by means of a pressing strip 16. The pressing strip 16 is secured in a setting 18 pivotally connected to the box 2, one side of said setting being provided with a cam 19 loaded by a spring 21.

The paper driving roller 17, which is coated with a rubber layer, is pivotally journalled on internal bearings (not shown) at either end. A shaft 22 passing through the bearings is secured to the side walls of the container 2.

Near one end of the shaft 22 a chain wheel 23 is journalled, over which a chain 24 is laid. The chain 24 extends from a fixed fastening point 25 on tilting rod 5a, to a fixed fastening point 27 on the rear wall of the container 2 via the chain wheel 23 and via a pulley 25. A tension spring 28 suspends the pulley 26 from a fastening point 29 at the top edge of the rear wall of the container.

As appears when comparing FIGS. 1, 2 and 3, the distance between the chain wheel 23 and the fastening point 25 on the tilting rods 5a increases when the container 2 tilts and hinges from the vertical position to the substantially horizontal position. This implies that the chain wheel 23 is rotatably driven during this movement of container 2. The tension spring 28 elongates to accommodate movement of pulley 26.

Figure 5:
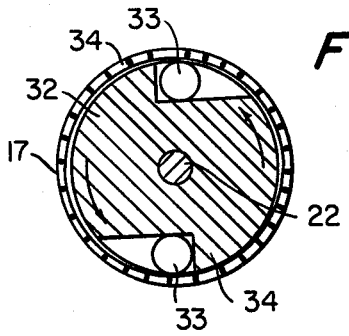
FIG. 5 is a sectional view of the structure of FIG. 4 taken along the line V—V.

The chain wheel 23 is connected with a free wheel coupling 31 inserted for the greater part into the paper driving roller 17. A section of the free wheel coupling 31 is shown in FIG. 5. For the rest, various principles known per se may be applied for a similar free wheel coupling.

With the embodiment shown in section in FIG. 5, use is made of so-called torpedo boss 32, consisting of a round disc having two recesses. A ratchet 33 is fastened by a small spring 34 in each recess. In the direction of rotation for shaft 22 and disc 32 as indicated by the arrows, the roller 17 is carried along, however, in the opposite direction of rotation, the roller 17 does not rotate with shaft 22.

In the device of FIGS. 1-5, the free wheel coupling 31 acts in such a manner that the roller 17 is driven by the chain 24 and the chain wheel 23 when the container 2 is moved from the vertical position to the substantially horizontal position. The roller 17 is at a standstill when the container moves in the opposite direction. When the roller 17 rotates, the adhering sheet from the paper stack 14 is conveyed from the container 2 and deposited upon the closet seat 1. Obviously, the speed of conveyance exerted to the paper sheet by the roller 17 should be synchronized with respect to the speed at which the roller is displaced with respect to the closet seat as a result of the tilting movement of the container.

It is essential that, at the end of the driving motion of the roller 17, no following paper sheet is caught and conveyed by roller 17 over a short distance. Therefore, at the end of the swinging motion of the container 2, the cam 19 of the setting 18 of the pressing strip 16 comes in touch with a cam 35 fastened to the tilting rod 4a. Consequently, the pressing strip 16 is disengaged from the roller 17 and exerts no pressure upon the stack 14.

It is also important that once the container 2 moves sufficiently to cause a sheet to be partly conveyed from the container, the paper sheet should first be entirely conveyed from the container 2 before the container may resume its starting position. For proper operation of the device, therefore it is essentialy that precaution be taken to prevent the container 2 from being permitted to move in the opposite direction during the greater part of its tilting motion.

For this purpose, as appears from FIGS. 1, 2 and 3, a hinging cam 37 loaded in one direction by a spring 36 is secured to the tilting rod 5a, and cooperates with a cam surface 38 on stationary frame 36. Tilting of the lever 5a can be effected in the direction of the arrow only until the parts reach the position shown in FIG. 3. If loading is effected in the opposite direction, the cam 37 engages against the surface 38 should an attempt be made to tilt the parts in the opposite direction before reaching the FIG. 3 position.

Figure 6:
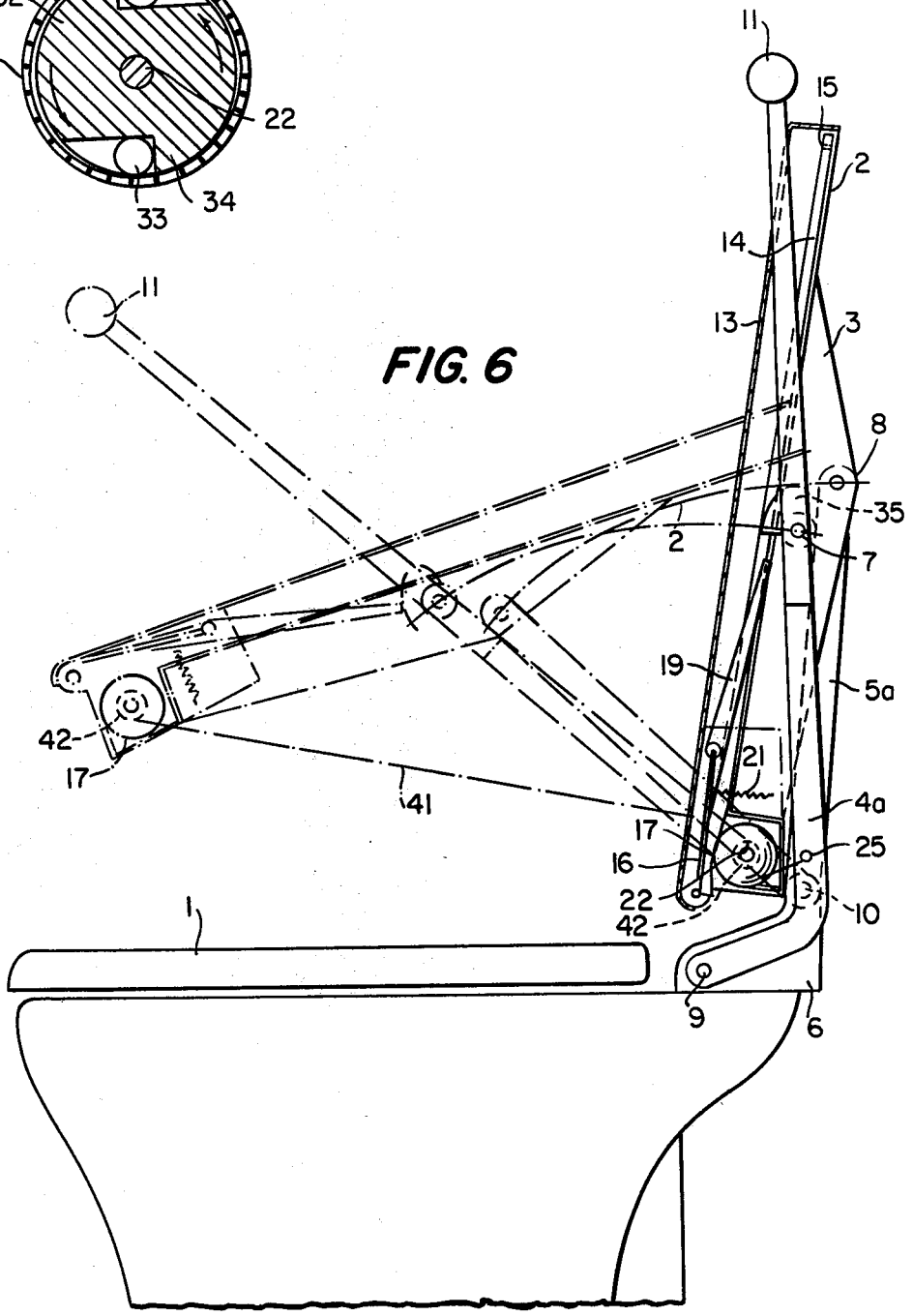
FIG. 6 is a side view of a second embodiment illustrating in full lines the position of parts in a non-operated, and in dot-dash lines the position of parts in a partly tilted position.
Figure 7:
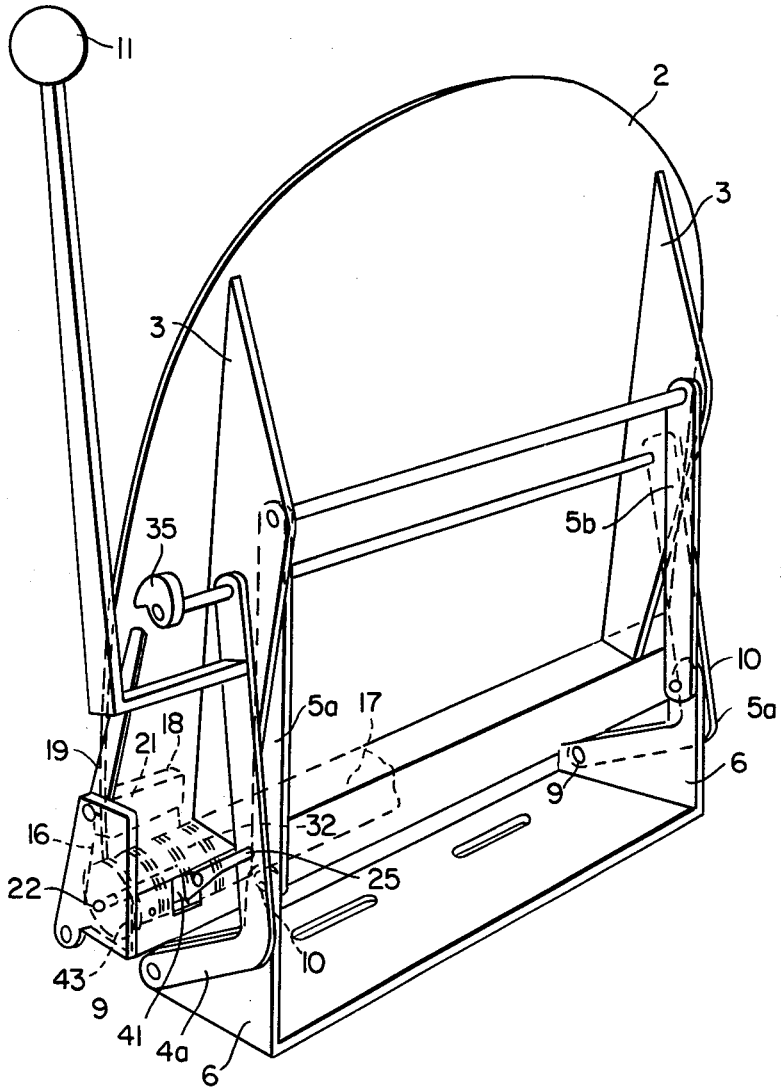
FIG. 7 shows a perspective view of the rear of the embodiment of FIG. 6.

The embodiment according to FIGS. 6 and 7 largely corresponds to that according to FIGS. 1 up to 5 inclusive. Corresponding parts are marked with the same reference numerals.

The main difference consists in that, for the driving of the paper driving roller 17 a belt 41 is used instead of a chain. Belt 41 extends from a fixed fastening point 25 on a tilting rod and is wound round a wheel 42 and secured to it at its other end. In its turn, the wheel 42 is connected with the roller 17 via a free wheel coupling. By means of a helical leaf spring 43 (having the same function as the tension spring 28 in the first embodiment) the wheel 42 is loaded in a direction in which the belt 41 is wound up.

Here too, it applies that, when the container 2 is tilted and hinged from the vertical position to the horizontal position, the distance between the fastening point 25 and the wheel 42 increases so that the wheel 42 and, via the free wheel coupling, also the roller 17 is rotated. When the container is tilted backwards, the belt is wound on the wheel 42 by means of the helical leaf spring 43 while the roller 17 does not rotate.

Since, when directed upwards, the belt takes up no space, the container 2, in the embodiment according to FIGS. 6 and 7, can have the rounded-off shape shown in the figures, which shape is adjusted to the shape of the paper strip.

In order to prevent a paper sheet from adhering to the roller 17, a fork may be fastened to the rear wall of the container 2, the teeth of which fit into grooves in the rubber coating of the roller.

The cam 19 could be operated manually, e.g., by means of a control button, to disengage the pressing strip from the roller 17. This may be necessary to introduce a new paper pile into the container in the correct position.

Within the scope of the following claims, various modifications of the described and represented devices are possible.

I claim:

1. A device to apply a paper sheet to a closet seat, comprising a box-shaped container for a stack of paper sheets fitting the closet seat, a tilting mechanism, means pivotally connecting said container to said tilting mechanism, said tilting mechanism being operable to tilt and hinge said container from a vertical position to a substantially horizontal position, a paper driving roller journalled within the container, a driving mechanism for rotating the roller in one direction when the container is tilted and hinged to the substantially horizontal position, and a pressing mechanism operable to press part of the paper stock on to the paper driving roller, whereby when the container is tilted and hinged from a substantially vertical to a substantially horizontal position, the roller is made to rotate and convey a single paper sheet longitudinally off the stack through an opening in the container.

2. A device according to claim 1, characterized in that the tilting mechanism is formed by a pair of tilting rods mounted on either side of the paper container, each of said rods having a pivoted connection with a fixed frame and with the container.

3. A device according to claim 1 characterized in that the driving mechanism for the paper driving roller consists of a belt or chain extending around a wheel, connected with the paper driving roller via a free wheel coupling.

4. A device according to claim 3, characterized in that the driving mechanism consists of a chain extending from a fixed fastening point on the tilting mechanism to a fixed fastening point on the container via a chain wheel and a pulley loaded upwardly by a spring.

5. A device according to claim 3, characterized in that the driving mechanism consists of a belt which extends around a wheel loaded in one direction by a helical spring and one end of which is fastened to the tilting mechanism or the frame.

6. A device according to claim 1, characterized in that the pressing mechanism consists of a tilting strip applied in front of the paper driving roller, said strip being biased towards the roller by a spring.

7. A device according to claim 6, characterized in that the tilting strip is provided with a cam which, during the final stretch of the swinging motion of the container, comes in contact with a cam on one of the tilting rods to disengage said strip from the paper driving roller.

8. A device according to claim 1, characterized in that the tilting mechanism of the container is provided with means operable to prevent a backward motion of the container over a considerable part of the tilting and hinging movement thereof.

9. A device according to claim 8, characeterized in that said means to prevent the backward motion of the container includes a cam pivotally secured to said tilting mechanism, said cam being loaded in one direction by a spring and cooperable with a fixed cam surface.

10. A device according to claim 1, characterized in that a cam is secured to the rear wall, said cam having teeth which fit into grooves in the roller.

* * * * *